United States Patent [19]

Dougherty

[11] Patent Number: 4,465,640

[45] Date of Patent: Aug. 14, 1984

[54] ADJUSTABLE CHOKE LINKAGE MEANS

[75] Inventor: Michael Dougherty, East Detroit, Mich.

[73] Assignee: Colt Industries Operating Corp, New York, N.Y.

[21] Appl. No.: 386,725

[22] Filed: Jun. 9, 1982

[51] Int. Cl.[3] ..... F02M 1/10

[52] U.S. Cl. ..... 261/39 B; 74/571 R; 74/522

[58] Field of Search ..... 261/39 B; 74/571 R, 74/522

[56] References Cited

U.S. PATENT DOCUMENTS

| | | | |
|---|---|---|---|
| 276,292 | 4/1883 | Seymour | 74/571 R |
| 447,386 | 3/1891 | Vuillier | 74/571 |
| 543,667 | 7/1895 | Baker et al. | 74/571 |
| 2,282,376 | 5/1942 | Phillips | 261/39 B |
| 2,477,587 | 8/1949 | Doutt | 74/571 R |
| 2,832,225 | 4/1958 | Hart | 74/600 |
| 3,075,403 | 1/1963 | Hepner | 74/600 |
| 3,088,320 | 5/1963 | Saxby | 261/39 B |
| 3,577,801 | 5/1971 | Netta | 74/571 R |
| 3,606,983 | 9/1971 | Mitchell | 261/39 B |
| 4,196,156 | 4/1980 | Rogerson et al. | 261/39 B |

*Primary Examiner*—Tim R. Miles

*Attorney, Agent, or Firm*—Walter Potoroka, Sr.

[57] ABSTRACT

A carburetor situated on an intake manifold of an engine is shown having an induction passage with a choke valve therein mounted on a choke shaft which in turn has a choke control lever; a thermostatic control situated on a different portion of the intake manifold is operatively connected to the choke control lever as through a rod linkage; a selectively adjustable retainer carried by the choke lever operatively engages the rod linkage; the retainer is adjustable to accommodate variations in the effective distance as between the choke lever and the thermostatic control to be spanned by the rod linkage.

13 Claims, 11 Drawing Figures

ADJUSTABLE CHOKE LINKAGE MEANS

FIELD OF THE INVENTION

This invention relates generally to the field of fuel metering means for combustion engines and more particularly to linkage means employed therein for controlling the movement of related elements as, for example, a choke or air valve and associated motion transmitting rod means connected as to related thermostatic means.

BACKGROUND OF THE INVENTION

Heretofore problems have been experienced in providing the interconnecting linkage means which operatively interconnects the thermostatic control means with the carburetor choke valve means. Even though the problem has been experienced in both situations wherein the thermostatic control means is carried by the carburetor body means and wherein the thermostatic control means is divorced from the carburetor and carried as by some related portion of the associated engine, the problem is even greater in the situation where a divorced thermostatic means is employed.

That is, for example a divorced thermostatic control arrangement, with all of the dimensional tolerances normally required for: (a) the casting and machining of (for example) the intake manifold onto which the thermostatic control means may be situated; (b) the machining of the carburetor body which is situated as on a different machined portion of the intake manifold; (c) the forming of the choke operating lever; (d) the thickness of the various associated gaskets; and (e) the forming of the linkage for interconnecting the thermostatic control means with the choke operating or control lever, the resulting algebraic total or accumulation of the actual dimensional tolerances of all of such components usually results in the linkage interconnecting the thermostatic control and choke lever being of an actual length inappropriate for effecting a proper interconnection thereof.

Accordingly, the invention as herein disclosed is intended to provide a solution to such and other attendant and related problems. As will become apparent, however, the invention can be practiced in other structures which are not even related to the fuel metering art.

SUMMARY OF THE INVENTION

According to the invention wherein first and second linkage members are to be operatively interconnected to each other, a retainer means is carried by said first linkage member, the retainer means comprises a passage-like portion and is selectively positionable relative to the first linkage member so as to thereby with every selected position change the location of the passage-like portion relative to the first linkage member, and said passage-like portion being effective to operatively receive said second linkage member.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF PREFERRED EMBODIMENT

Figure 1:
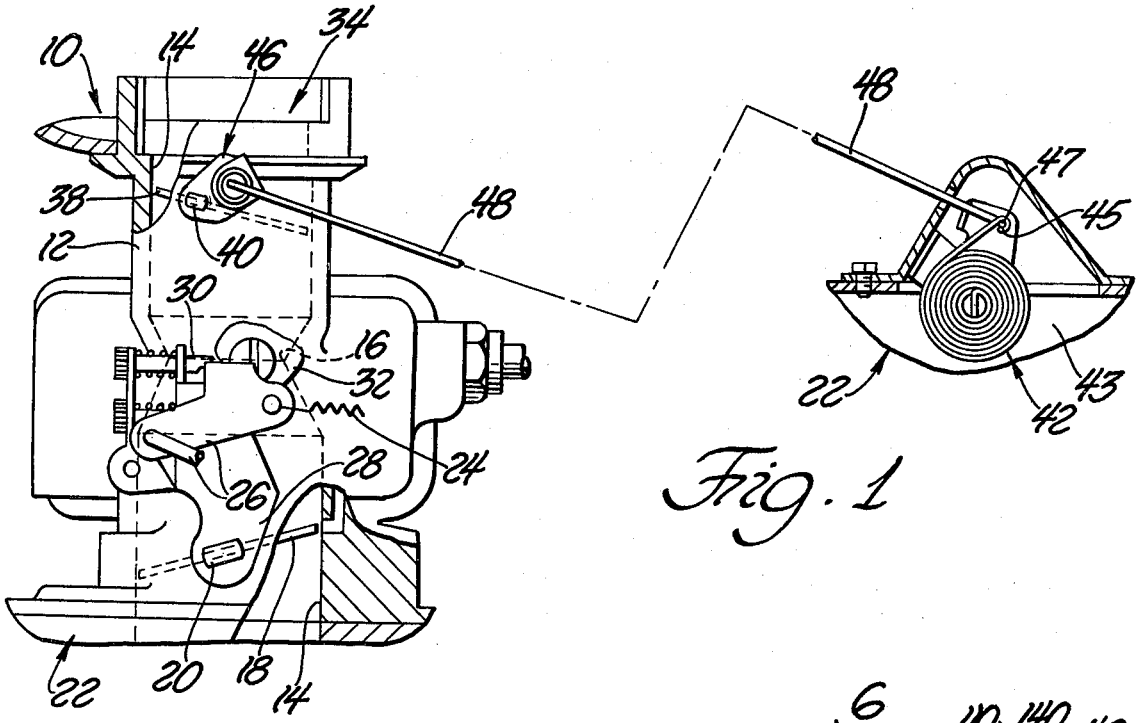
FIG. 1 illustrates a carburetor structure, partially broken away and cross-hatched, employing teachings of the invention.

Referring now in greater detail to the drawings, FIG. 1 illustrates a carburetor 10 comprising a carburetor body 12 formed to provide induction passage means 14 having, for example, the usual venturi means 16 and a throttle valve 18, within the induction passage means downstream of the venturi 16, pivotally mounted as on a manually positionable throttle shaft 20. The entire carburetor assembly 10 is illustrated as being suitably secured atop an engine intake manifold structure 22.

The throttle valve 18 is opened, as against the force of a spring 24 urging it closed, in the usual manner as by means of suitable linkage 26 connected as between the throttle lever 28 and the operator's foot pedal (not shown). As is customary, closure of the throttle 18 may be limited by an adjustable stop screw 30 adapted to be rotated with the throttle valve and engageable with one of a plurality of cam-like steps (not shown) formed on or carried by a fast idle cam (fragmentarily illustrated at 32) which is positioned generally by the choke mechanism 34 as through interconnecting lost motion linkage means (not shown but well known in the art).

The choke mechanism comprises a choke valve 38 mounted as on a shaft 40 for pivotal rotation therewith and within the induction passage means 14 upstream of the venturi means 16. As is often the case, the choke valve 38 may be unbalanced to open by gravity and in response to air flow through the induction passage. In such case the force of the air tending to open the choke valve 38 is opposed as by a coiled thermostatic spring 42 which, in the illustration of FIG. 1, is depicted as being at least partially situated within a stove-like chamber 43 of the engine intake manifold 22. As generally depicted, one end 45 of thermostatic means is operatively connected as to one end 47 of linkage rod means 48 which has its other end 49 pivotally connected to choke lever means 46 secured to choke shaft 40 for rotation therewith. The opposing force of the thermostatic means 42 is at a maximum when the engine is cold and is progressively relaxed as the engine warms up. The choke lever means 46 may, in turn, as is well known in the art, be operatively connected to the fast idle cam 32 as through intermediate lost motion linkage means.

In addition to the described thermostatic arrangement, suitable pressure responsive motor means or solenoid means (not shown but well known in the art) may be provided for causing an initial preselected degree of opening of the choke valve 38, against the force of thermostatic means 42, whenever the engine is started cold.

Figure 2:
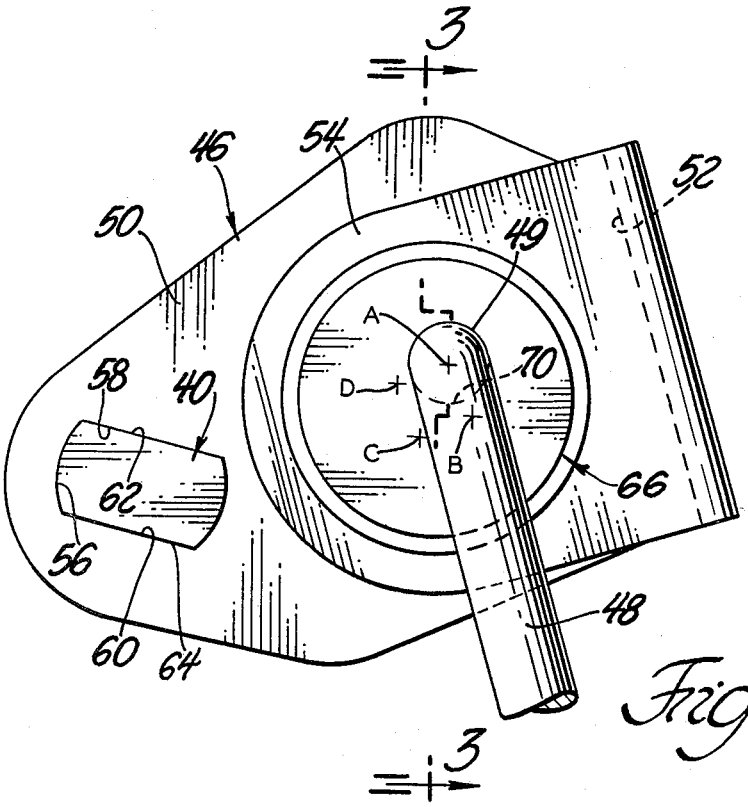
FIG. 2 is an enlarged view of certain of the elements shown in FIG. 1.
Figure 3:
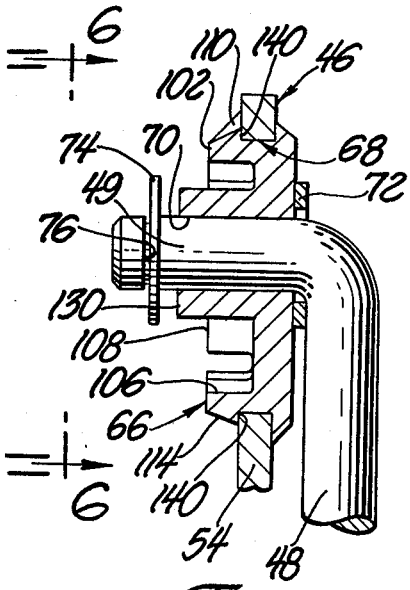
FIG. 3 is a cross-sectional view taken generally on the plane of line 3—3 of FIG. 2 and looking in the direction of the arrows.

Referring to FIGS. 2 and 3 the choke lever means 46 is illustrated as comprising a lever main body 50 having a generally laterally extending portion 52 integrally formed with and carrying an arm-like portion 54. Lever main body 50 is provided as with an aperture 56 having flatted portions 58, 60 which cooperatingly engage juxtaposed flatted portions 62, 64 of choke shaft 40.

A variably adjustably positioned insert-like retainer means 66 is received within aperture means 68 formed in lever arm portion 54 and, in turn, pivotally receives end 49 of linkage rod 48 through passage 70 formed therethrough. A separate washer member or an integral bead 72 may be provided as generally between retainer means 66 and rod 48 while a suitable snap-ring 74, or the like, carried as within an annular groove 76 of end 49 serves to prevent unauthorized withdrawal of end 49 from passage 70.

The relative position of lever means 46 of FIG. 2 corresponds to that as shown in FIG. 1 and it may be assumed that at such position the choke valve 38 is in its fully closed position. The position of motion transmitting rod 48 as shown in FIG. 2 is somewhat revolved from that as shown in FIG. 1. The rod 48 in its position as depicted in FIG. 2 would be more customary as the thermostatic means 42 is often situated in somewhat close proximity to and at a level relatively near the base of the carburetor means 10.

Figure 4:
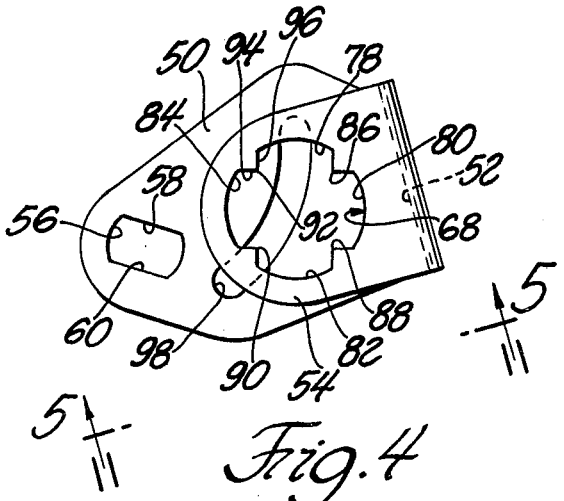
FIG. 4 is a view, in reduced scale, of one of the elements shown in FIG. 2.
Figure 5:
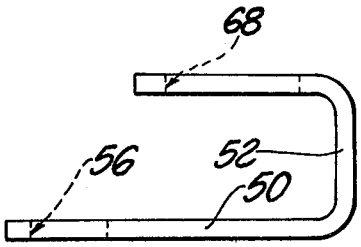
FIG. 5 is a view taken generally on the plane of line 51'5 of FIG. 4 and looking in the direction of the arrows.

Referring now in greater detail to FIGS. 4 and 5, the aperture means 68 is illustrated as comprising four arcuate segments 78, 80, 82 and 84 which, preferably, are all coincident with a common circle. Generally spacing such arcuate segments are generally equally spaced V-like projections 86, 88, 90 and 92 arranged as to have the respective apexes thereof directed generally radially inwardly. Each of the projections 86, 88, 90 and 92 have opposite edges or surfaces, as typically illustrated at 94 and 96, which extend from the respective apexes to the respective adjoining arcuate segments. In the preferred embodiment of the invention main body portion 50 has an elongated arcuate slot 98 formed therethrough which may be employed for the reception therein of one end of a linkage member (not shown) for operative connection with the fast idle cam 32 (FIG. 1) for positioning thereof in accordance with the position of choke valve 38.

Referring to FIGS. 6–11, the adjustably positionable pivotal retainer 66 is illustrated as comprising a disc-like body or end wall portion 100 with generally angularly equally spaced integrally formed arcuate (as viewed in FIG. 6) leg-like portions 102, 104, 106 and 108 terminating at their respective free ends in arcuate cam-like portions 110, 112, 114 and 116 each extending radially outwardly some distance beyond the arcuate leg portions. V-like spaces (as viewed in FIG. 6) 118, 120, 122 and 124, generally angularly equally spaced are each defined as by generally opposite end surfaces, as typically illustrated at 126 and 128, of generally adjacent arcuate leg portions.

Figure 6:
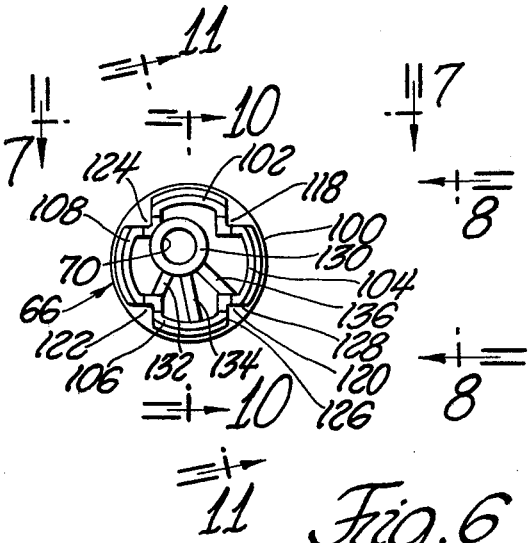
FIG. 6 is a view, in reduced scale, of one of the elements of FIGS. 2 and 3, taken generally on the plane of line 6—6 of FIG. 3 and looking in the direction of the arrows.
Figure 7:
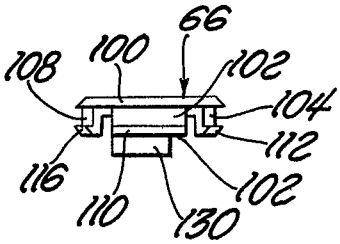
FIG. 7 is a view taken generally on the plane of line 7—7 of FIG. 6 and looking in the direction of the arrows.
Figure 8:
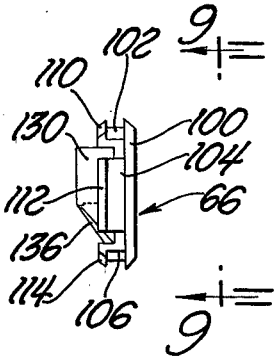
FIG. 8 is a view taken generally on the plane of line 8—8 of FIG. 6 and looking in the direction of the arrows.
Figure 9:
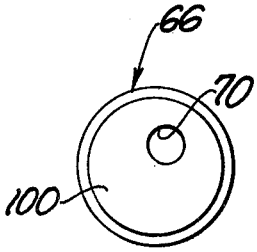
FIG. 9 is a view taken generally on the plane of line 9—9 of FIG. 8 and looking in the direction of the arrows.
Figure 10:
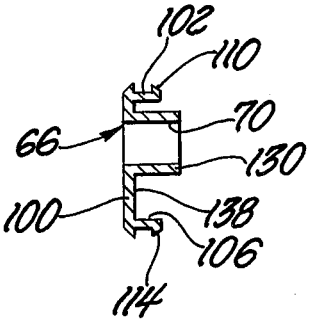
FIG. 10 is a cross-sectional view taken generally on the plane of line 10—10 of FIG. 6 and looking in the direction of the arrows.
Figure 11:
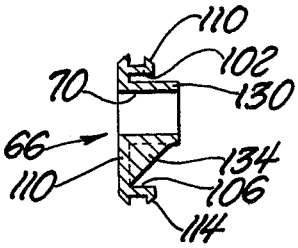
FIG. 11 is a cross-sectional view taken generally on the plane of line 11—11 of FIG. 6 and looking in the direction of the arrows.

Generally radially inwardly of the arcuate leg portions is a tubular portion 130 having passage 70 formed therethrough. The axis of passage 70 is such as to be generally parallel to the axis of body 100 but off-set with respect thereto. In FIG. 6, the axis of passage 70 is depicted as off-set to the left of a vertical axis passing through the central axis of body 100 and off-set upwardly of a horizontal axis passing through the same central axis of body 100. Suitable ribs or gussets 132, 134 and 136 are preferably provided in order to strengthen the tubular portion 130 and body 100 with respect to each other.

OPERATION OF INVENTION

In the preferred embodiment of the invention, the adjustable retainer means 66 is formed of relatively resiliently deflectable material such as, for example, nylon or the like, thereby enabling at least limited radial deflection of arcuate legs 102, 104, 106 and 108.

In assembling the retainer means 66 to arm portion 54 of lever 46 (referring to FIG. 3) the retainer 66 is positioned as to the right (as viewed in FIG. 3) of lever arm portion 54 and pushed to the left through aperture means 68. In so doing, the cam-like surfaces 110, 112, 114 and 116 engage the edge surface of aperture means 68 and force the respective free ends of the arcuate leg portions 102, 104, 106 and 108 generally radially inwardly (as viewed in FIG. 6) thereby enabling the passage of such leg portions and cam-like surfaces through the aperture means 68. When the retainer means 66 has been thusly sufficiently moved, the inner surface 138 of body portion 100 abuts against one side of lever arm 54 and, at that time, the cam-like surfaces have cleared the confines of apertures means 68 thereby permitting the arcuate leg portions 102, 104, 106 and 108 to resiliently move radially outwardly and engage juxtaposed portions of the aperture means 68. As a consequence thereof, the cam-like portions 110, 112, 114 and 116 move outwardly and the respective inner surface 140 of each of the cam-like portions engages the opposite side of lever arm 54 as to preclude inadvertent withdrawal of retainer means 66 from aperture means 68.

In assembling the retainer means 66 to lever arm 54, in the preferred embodiment, there are four selectable relative positions. In, for example, Position-1 (as generally depicted in FIG. 2):

(a) arcuate leg 102 will be juxtaposed to arcuate aperture segment 78;
(b) arcuate leg 108 will be juxtaposed to arcuate aperture segment 80;
(c) arcuate leg 106 will be juxtaposed to arcuate aperture segment 82;
(d) arcuate leg 104 will be juxtaposed to arcuate aperture segment 84;
(e) V-like extension 86 will be received in V-like space 124;

(f) V-like extension 88 will be received in V-like space 122;
(g) V-like extension 90 will be received in V-like space 120;
(h) V-like extension 92 will be received in V-like space 118;
(i) surfaces 128 will be juxtaposed to surfaces 96 and
(j) surfaces 126 will be juxtaposed to surfaces 94.

In Position-2 (wherein retainer means 66 is, arbitrarily, displaced 90° clockwise from the said Position-1) the elements would have the following relationships:

| Retainer Means 66 (Elements) | | Aperture Means 68 (Elements) |
|---|---|---|
| 102 | juxtaposed to | 80 |
| 108 | " | 82 |
| 106 | " | 84 |
| 104 | " | 78 |
| 118 | receives | 86 |
| 124 | " | 88 |
| 122 | " | 90 |
| 120 | " | 92 |
| 128—128 | juxtaposed to | 96—96 |
| 126—126 | " | 94—94 |

In Position-3 (wherein retainer means 66 is, arbitrarily, displaced 180° from the said Position-1) the elements would have the following relationships:

| Retainer Means 66 (Elements) | | Aperture Means 68 (Elements) |
|---|---|---|
| 102 | juxtaposed to | 82 |
| 108 | " | 84 |
| 106 | " | 78 |
| 104 | " | 80 |
| 120 | receives | 86 |
| 118 | " | 88 |
| 124 | " | 90 |
| 122 | " | 92 |
| 128—128 | juxtaposed to | 96—96 |
| 126—126 | " | 94—94 |

In Position-4 (wherein retainer means 66 is, arbitrarily, displaced 270° clockwise from the said Position-1) the elements would have the following relationships:

| Retainer Means 66 (Elements) | | Aperture Means 68 (Elements) |
|---|---|---|
| 102 | juxtaposed to | 84 |
| 108 | " | 78 |
| 106 | juxtaposed to | 80 |
| 104 | " | 82 |
| 122 | receives | 86 |
| 120 | " | 88 |
| 118 | " | 90 |
| 124 | " | 92 |
| 128—128 | juxtaposed to | 96—96 |
| 126—126 | juxtaposed to | 94—94 |

As generally depicted in FIG. 2, depending upon which position of retainer means 66 (relative to lever arm 54) is selected, ie. Positions 1, 2, 3 or 4, the corresponding relative position of the axis of passage 70 (and linkage end 49) will be at either A, B, C or D, respectively.

If it is assumed that the normal operating position of linkage or rod 48 is that as generally depicted in FIG. 2 and that the other end of rod 48 (which is not shown in FIG. 2) is secured to some other element, then it is apparent that, effectively, the various possible axis locations of A, B, C and D give a range of lengths of such a rod 48 which will be accommodated. That is, the shortest rod 48 which would be accommodated is one which would extend (from its other secured end not shown in FIG. 2) as to have its end 49 axis generally coincident with the axis at C while the longest rod 48 which would be accommodated is one which would extend (from its other secured end not shown in FIG. 2) as to have its end 49 axis generally coincident with the axis at A. The axes at B and D accommodating rods 48 of intermediate lengths.

Although the invention is not so limited, the invention has arisen out of the solution of the problem of being able to interconnect the thermostatic means to the choke valve operating lever where the carburetor assembly is situated on one machined surface of an engine intake manifold, the thermostatic means is of the divorced type (not carried directly by the carburetor assembly but rather by another structure related to or associated with the engine) situated as on another machined surface of the engine intake manifold and a rod linkage member is employed to interconnect the thermostatic means and the choke operating lever.

It should be apparent that with all of the dimensional tolerances required for: (a) the casting and machining of the intake manifold; (b) the machining of the carburetor body; (c) the forming of the choke lever; (d) the thickness of the various associated gaskets; and (e) the forming of the interconnecting rod linkage (48) that the various "stack-up" (additive effect of the individual dimensional tolerances) of tolerances would often result in a rod linkage (48) of an actual length inappropriate to affect a proper interconnection as between the choke lever and thermostatic means. Accordingly, in one aspect of the invention, the difference in actual lengths represented by the extremes of the axis positions of A to c was made to equal the total of the possible dimensional tolerance "stack-up" or accummulation which could arise. Therefore, regardless of what the accummulation of tolerances may do to the apparent location of end 49 of rod 48, any such variation can be accommodated merely by selectively positioning retainer means 66 as to place the axis of passage 70 substantially or generally coincident with the axis of end 49 of rod 48. Further, even though it may not be immediately obvious, the adjustment provided by the selectively positionable retainer means enables the necessary accommodation to make the proper connection with linkage means 48 without in any way requiring movement of the lever body 50 which movement would alter its relationship with any rod or the like connected to slot 98.

The invention has been described with reference to a carburetor structure; however, the invention is, of course, not so limited in that it is apparent that the inventive concept can be practiced in structures which are not even related to the fuel metering art.

Although only a preferred embodiment of the invention has been disclosed and described, it is apparent that other embodiments and modifications of the invention are possible within the scope of the appended claims.

What is claimed is:

1. The combination of a carburetor, an induction passage formed through said carburetor for supplying motive fluid to an associated engine, a choke valve situated in said induction passage for variably restricting the flow of air into said induction passage, a choke control lever means operatively connected to said choke valve for movement in unison therewith, said choke control lever means comprising a lever member and retainer means carried by said lever member and selectively positionable with respect thereto, said retainer means comprising journalling means, said journalling means assuming differing positions relative to said lever member as said retainer means is selectively positioned to differing positions relative to said lever member, thermostatic choke control means, linkage means having at least first and second ends, said linkage means having said first end operatively connected to said thermostatic choke control means and having said second end operatively connected to said journalling means of said retainer means, said lever member comprising an opening formed therein, said retainer means being comprised of relatively resiliently deflectable material, said retainer means being resiliently deflectable as to by such deflection be operatively received by said opening, and abutment means carried by said retainer means, said abutment means being effective to preclude said retainer means from moving relative to said lever member once said retainer means is operatively received by said opening, once said retainer means is operatively received by said opening said retainer means becomes capable of assuming a differing position relative to said lever member only upon said retainer means first undergoing resilient deflection and withdrawal from said opening.

2. The combination of claim 1 wherein said thermostatic choke control means is physically separated from said carburetor spaced therefrom and supported by structure other than said carburetor.

3. The combination of claim 1 wherein said journalling means comprises a bearing surface formed in said retainer means.

4. The combination of claim 1 wherein said journalling means comprises a bearing passage formed through said retainer means.

5. The combination of claim 1 wherein said second end of said linkage means has at least a portion thereof formed to be generally cylindrical, and wherein said generally cylindrical portion is pivotally received by said journalling means.

6. The combination of claim 1 wherein said linkage means comprises a rod-like member, wherein at least said second end of said rod-like member is of generally cylindrical configuration, and wherein said second end is pivotally received by said journalling means.

7. The combination of claim 1 wherein said retainer means comprises a main body portion, said body portion comprising generally outer peripheral surface means, said generally outer peripheral surface means comprising groove-like recess means, said groove-like recess means being effective to receive therein that portion of said lever member which serves to define said opening.

8. The combination of claim 7 wherein a portion of said generally outer peripheral surface means comprises cam-like surface means, and wherein said cam-like surface means is effective to operatively engage said portion defining said opening and undergo resilient deflection in a direction generally inwardly of said opening when said retainer means is being urged generally into said opening for assembly with said lever member.

9. The combination of claim 8 wherein once said retainer means is urged into said opening and assembled to said lever member at least a part of said portion defining said opening is received by said groove-like recess means and said cam-like surface means resiliently moves in a direction generally outwardly of said opening thereby containing said part of said portion defining said opening in said groove-like recess means.

10. The combination of a combustion engine, an intake manifold for supplying motive fluid to said engine, a carburetor operatively carried by said intake manifold, an induction passage formed through said carburetor for supplying said motive fluid to said intake manifold, a choke valve situated in said induction passage for variably restricting the flow of air into said induction passage, a choke control lever means operatively connected to said choke valve for movement in unison therewith, said choke control lever means comprising a lever member and retainer means carried by said lever member and selectively positionable with respect thereto, said retainer means comprising journalling means, said journalling means assuming differing positions relative to said lever member as said retainer means is selectively positioned to differing positions relative to said lever member, thermostatic choke control means, and linkage means having at least first and second ends, said linkage means having said first end operatively connected to said thermostatic choke control means and having said second end operatively connected to said journalling means of said retainer means, wherein said lever member comprises aperture means, wherein said retainer means is received by said aperture means, wherein said retainer means is at least comprised of relatively resiliently deflectable materials, wherein said aperture means is of generally circular configuration, wherein said retainer means comprises at least portions thereof which are generally circular in configuration, and wherein said aperture means further comprises abutment means effective for operatively engaging said retainer means to prevent undesired rotation of said retainer means within said aperture means.

11. The combination of a combustion engine, an intake manifold for supplying motive fluid to said engine, a carburetor operatively carried by said intake manifold, an induction passage formed through said carburetor for supplying said motive fluid to said intake manifold, a choke valve situated in said induction passage for variably restricting the flow of air into said induction passage, a choke control lever means operatively connected to said choke valve for movement in unison therewith, said choke control lever means comprising a lever member and retainer means carried by said lever member and selectively positionable with respect thereto, said retainer means comprising journalling means, said journalling means assuming differing positions relative to said lever member as said retainer means is selectively positioned to differing positions relative to said lever member, thermostatic choke control means, and linkage means having at least first and second ends, said linkage means having said first end operatively connected to said thermostatic choke control means and having said second end operatively connected to said journalling means of said retainer means, wherein said thermostatic choke control means is spaced from said carburetor and operatively carried by said intake manifold, wherein said journalling means comprises a bearing passage formed through said retainer means, wherein said second end of said linkage means has at least a portion thereof formed to be generally cylindrical, wherein said generally cylindrical portion is pivotally received by said bearing passage, wherein said lever member comprises aperture means, wherein said retainer means is received by said aperture means, wherein said retainer means is at least comprised of relatively resiliently deflectable material, wherein said aperture means is of generally circular configuration, wherein said retainer means comprises at least portions thereof which are generally circular in configuration, and wherein said aperture means comprises abutment means effective for operatively engaging said retainer means to prevent undesired rotation of said retainer means within said aperture means.

12. The combination of a carburetor, an induction passage formed through said carburetor for supplying motive fluid to an associated engine, a choke valve situated in said induction passage for variably restricting the flow of air into said induction passage, a choke control lever means operatively connected to said choke valve for movement in unison therewith, said choke control lever means comprising a lever member and retainer means carried by said lever member and selectively positionable with respect thereto, said retainer means comprising journalling means, said journalling means assuming differing positions relative to said lever member as said retainer means is selectively positioned to differing positions relative to said lever member, thermostatic choke control means, and linkage means having at least first and second ends, said linkage means having said first end operatively connected to said thermostatic choke control means and having said second end operatively connected to said journalling means of said retainer means, wherein said lever member comprises aperture means, wherein said retainer means is received by said aperture means, wherein said retainer means is at least comprised of relatively resiliently deflectable material, wherein said aperture means is of generally circular configuration, wherein said retainer means comprises at least portions thereof which are generally circular in configuration, and wherein said aperture means further comprises abutment means effective for operatively engaging said retainer means to prevent undesired rotation of said retainer means within said aperture means.

13. The combination of a carburetor, an induction passage formed through said carburetor for supplying motive fluid to an associated engine, a choke valve situated in said induction passage for variably restricting the flow of air into said induction passage, a choke control lever means operatively connected to said choke valve for movement in unison therewith, said choke control lever means comprising a lever member and retainer means carried by said lever member and selectively positionable with respect thereto, said retainer means comprising journalling means, said journalling means assuming differing positions relative to said lever member as said retainer means is selectively positioned to differing positions relative to said lever member, thermostatic choke control means, and linkage means having at least first and second ends, said linkage means having said first end operatively connected to said thermostatic choke control means and having said second end operatively connected to said journalling means of said retainer means, said thermostatic choke control means being spaced from said carburetor as to be operatively carried by said associated engine, wherein said journalling means comprises a bearing passage formed through said retainer means, wherein said second end of said linkage means has at least a portion thereof formed to be generally cylindrical, wherein said generally cylindrical portion is pivotally received by said bearing passage, wherein said lever member comprises aperture means, wherein said retainer means is received by said aperture means, wherein said retainer means is at least comprised of relatively resiliently deflectable material, wherein said aperture means is of generally circular configuration, wherein said retainer means comprises at least portions thereof which are generally circular in configuration, and wherein said aperture means comprises abutment means effective for operatively engaging said retainer means to prevent undesired rotation of said retainer means within said aperture means.

* * * * *